US007124521B1

(12) United States Patent
Medoro

(10) Patent No.: US 7,124,521 B1
(45) Date of Patent: Oct. 24, 2006

(54) APPARATUS FOR RESURFACING AN ICE SURFACE

(76) Inventor: Adam Paul Medoro, 41 Hamptonbrook Drive, Toronto, Ontario (CA) M9P 1A2

( * ) Notice: Subject to any disclaimer, the term of this patent is extended or adjusted under 35 U.S.C. 154(b) by 210 days.

(21) Appl. No.: 10/728,585

(22) Filed: Dec. 8, 2003

(51) Int. Cl.
*E01H 5/10* (2006.01)
*B05B 1/20* (2006.01)

(52) U.S. Cl. ..... 37/227; 37/285; 299/24; 239/158; 239/266

(58) Field of Classification Search ..... 37/247, 37/285, 227, 219; 299/24–28; 239/146, 239/147, 149, 159, 164–168, 172, 176
See application file for complete search history.

(56) References Cited

U.S. PATENT DOCUMENTS

| | | | | | |
|---|---|---|---|---|---|
| 3,302,975 | A * | 2/1967 | Vandenberg | 299/24 |
| 3,475,056 | A * | 10/1969 | Jones | 299/24 |
| 3,705,746 | A | 12/1972 | McLeod | |
| 3,917,350 | A * | 11/1975 | Bricher | 299/24 |
| 3,930,647 | A | 1/1976 | Berlemont | |
| 4,353,505 | A * | 10/1982 | Kinder | 239/167 |
| 4,638,948 | A * | 1/1987 | Marlek | 239/722 |
| 4,725,004 | A * | 2/1988 | Baran, Jr. | 239/164 |
| 4,828,177 | A * | 5/1989 | Schuitemaker | 239/165 |
| 4,893,751 | A * | 1/1990 | Armstrong | 239/150 |
| 4,914,923 | A | 4/1990 | Duplan et al. | |
| 5,134,857 | A | 8/1992 | Burley | |
| 5,771,698 | A | 6/1998 | Abel | |
| 5,771,706 | A | 6/1998 | Lavigne | |
| 6,053,426 | A * | 4/2000 | Robinson et al. | 239/127 |
| 2001/0000576 | A1 * | 5/2001 | Robinson | 134/169 C |

FOREIGN PATENT DOCUMENTS

| | | |
|---|---|---|
| WO | 9410393 | * 5/1994 |
| WO | 2004092485 | * 10/2004 |

* cited by examiner

*Primary Examiner*—Thomas A Beach

(57) ABSTRACT

An apparatus for resurfacing an ice surface includes a dolly including a body, a handle and a plurality of wheels attached thereto. The apparatus includes a device for operably receiving fluid from a reservoir and distributing fluid substantially evenly onto an ice surface. The device includes a valve connecting the reservoir to an elongate pipe that has a plurality of substantially evenly spaced perforations for allowing fluid to pass therethrough. An elongate support member extends along the length of the pipe and is secured thereto. An applicator is preferably connected to the support member for receiving fluid and for assisting to evenly apply fluid onto an ice surface. The opposed end portions of the pipe and support member are movable between up and down positions for adjusting the amount of water dispensed onto an ice surface.

16 Claims, 4 Drawing Sheets

APPARATUS FOR RESURFACING AN ICE SURFACE

CROSS REFERENCE TO RELATED APPLICATIONS

Not Applicable.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

1. Technical Field

This invention relates to tools used to maintain ice rinks and, more particularly, to an apparatus for effectively resurfacing an ice rink.

2. Prior Art

The popularity of ice-skating has increased the demand for indoor-ice time that is difficult, or in the case of towns and cities without indoor ice facilities, impossible to meet. According to statistics gathered by American Demographics, 3,800,000 children from 7 and 17 years of age will participate in ice skating in the year 2000. There are currently more than 300,000 amateur hockey players in the U.S. and that number is increasing by about 10 percent a year. Using the improved ice tool of this invention to resurface an ice rink, one that can be built in back yards or neighborhood parks, is very appealing.

In order to build and maintain an outdoor ice rink, a maximum outside temperature of 25 degrees F. above zero to a low of minus 10 degrees F. are needed, therefore, most of the outdoor rinks are in the Midwest and Northeastern states. In those states where outdoor temperatures permit it, many outdoor rinks are being built. However, even in states with very cold temperatures a mild winter or a mid-January thaw can significantly reduce the length of the outdoor skating season. It is, therefore, important to make use of the short season for skating and not to waste excessive amounts of time in making ice.

The traditional methods of building an outdoor ice rink require the use of plastic liners or rigid panels. Before either can be used, all the snow must be removed and the area leveled as much as possible. Both the plastic liner and the plastic panels require that a side be built up around the perimeter of the rink area with either snow or side boards. The area is then flooded with water from a hose or water truck. Ground areas are typically uneven which results in deeper water accumulations in lower areas and much thinner accumulations in others. As the water freezes, the deeper water accumulations are subject to the formation of air pockets. These air pockets eventually break out and weaken the ice. This invention dispenses water in thin layers that can be controlled. The result is stronger, smoother rink ice. In addition, the tool can be used successfully on uneven ground surfaces.

The various methods mentioned and weather factors significantly impact the quality and strength of ice. If several inches of water accumulate before the water can freeze solid, the resulting ice does not have the same tenacity as ice that is built up through the application of thin layers of water, preferably about ⅛ inch thick. Thin applications of water that are allowed to freeze before another water layer is added will produce a superior quality ice. The apparatus and method of this invention allow the user to apply water in thin layers that freeze quickly.

After the initial base layer of rink ice is established, it becomes necessary to recondition the ice periodically to keep it in good shape for skating. The standard practice is to flood the base ice with yet another layer of water using a hose or water truck. Water applied by these methods often begins to freeze before it has leveled itself or completely filled the rink area. The result is an uneven ice surface. The time typically required to complete the flooding and freezing operation can be up to a full day. This represents a significant loss of rink time for skaters. The tool of this invention provides a method and means to resurface the base ice with a thin, smooth layer of ice that freezes quickly, thereby reducing the time required to resurface the rink from a day to only a few minutes under some circumstances.

There is a definite need in both the public and private sectors for the apparatus of this invention. It provides a quick, easy method of building and maintaining rink ice at a relatively low financial cost when compared to other methods. It saves the user of the apparatus valuable time in a relatively short skating season. It helps to conserve water, a valuable natural resource and, there are no emissions to harm the atmosphere. The ice tool of this invention is portable, hand operable and easy to use while producing superior results. It is also economical, making it highly possible for commercial rinks as well as the typical homeowner to afford. It is the general object of this invention to provide an apparatus and method, which overcome the limitations and shortcomings of the prior art.

BRIEF SUMMARY OF THE INVENTION

In view of the foregoing background, it is therefore an object of the present invention to provide an apparatus for effectively resurfacing an ice rink. These and other objects, features, and advantages of the invention are provided by an apparatus for resurfacing an ice surface, which includes a dolly including a body and a handle attached thereto. The dolly further includes a plurality of wheels connected to the body and for supporting same thereon so that the dolly can be rolled on an ice surface.

The apparatus further includes a reservoir removably fastened onto the body and for housing fluid therein. The reservoir has a front end portion provided with a first aperture for receiving fluid therethrough and further has a rear end portion provided with a second aperture for dispensing fluid therefrom. The apparatus further includes a device for operably receiving fluid from the second aperture and distributing fluid substantially evenly onto an ice surface adjacent to the rear end portion of the reservoir.

The device includes a valve connected to the second aperture and for selectively allowing fluid to flow therefrom. An elongate pipe is connected to the valve and has a plurality of substantially evenly spaced perforations for allowing fluid to pass therethrough. An elongate support member preferably extends along the length of the pipe and is secured thereto at opposed end portions of the pipe and for assisting to maintain same at a substantially stable position during operating conditions.

A plurality of elongate ropes have one end portion attached to the rear end portion of the reservoir respectively and further have an opposed end portion attached to a corresponding end portion of the support member. Thus, the support member can be maintained at a substantially stable position during operating conditions. An applicator is preferably connected to the support member for receiving fluid and for assisting to evenly apply fluid onto an ice surface. The applicator may be formed from cloth material.

The pipe may include a plurality of flexible couplings spaced apart along a length thereof. The support member may include a plurality of hinges spaced apart along a length thereof and substantially aligned with the plurality of flexible couplings. Further, the plurality of ropes each may include a fastener attached along a length thereof respectively and removably fastenable to the rear end portion of the reservoir.

Advantageously, the respective opposed end portions of the pipe and the support member are movable between down and up positions about the plurality of flexible couplings and the plurality of hinges so that the amount of fluid dispensed from the pipe can be adjusted as needed. The pipe and the support member are also maintainable at up positions when each fastener is connected to the rear end portion of the reservoir respectively.

The front-end portion of the reservoir is preferably positioned above the rear end portion thereof and for assisting to drain fluid from the reservoir. The apparatus may further include a plate secured to the dolly. The plate includes a pin for pivotally connecting same to the handle so that the dolly can be pulled in different directions during operating conditions.

The apparatus may further include a cap removably attachable to the first aperture of the reservoir and for preventing undesirable elements from entering the reservoir. Furthermore, one of the plurality of wheels may be operably connected to the handle so that it can be caused to move in a direction corresponding to the movement of the handle.

BRIEF DESCRIPTION OF THE SEVERAL VIEWS OF THE DRAWING

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

DETAILED DESCRIPTION OF THE INVENTION

The present invention will now be described more fully hereinafter with reference to the accompanying drawings, in which a preferred embodiment of the invention is shown. This invention may, however, be embodied in many different forms and should not be construed as limited to the embodiment set forth herein. Rather, this embodiment is provided so that this application will be thorough and complete, and will fully convey the true scope of the invention to those skilled in the art.

Figure 1:
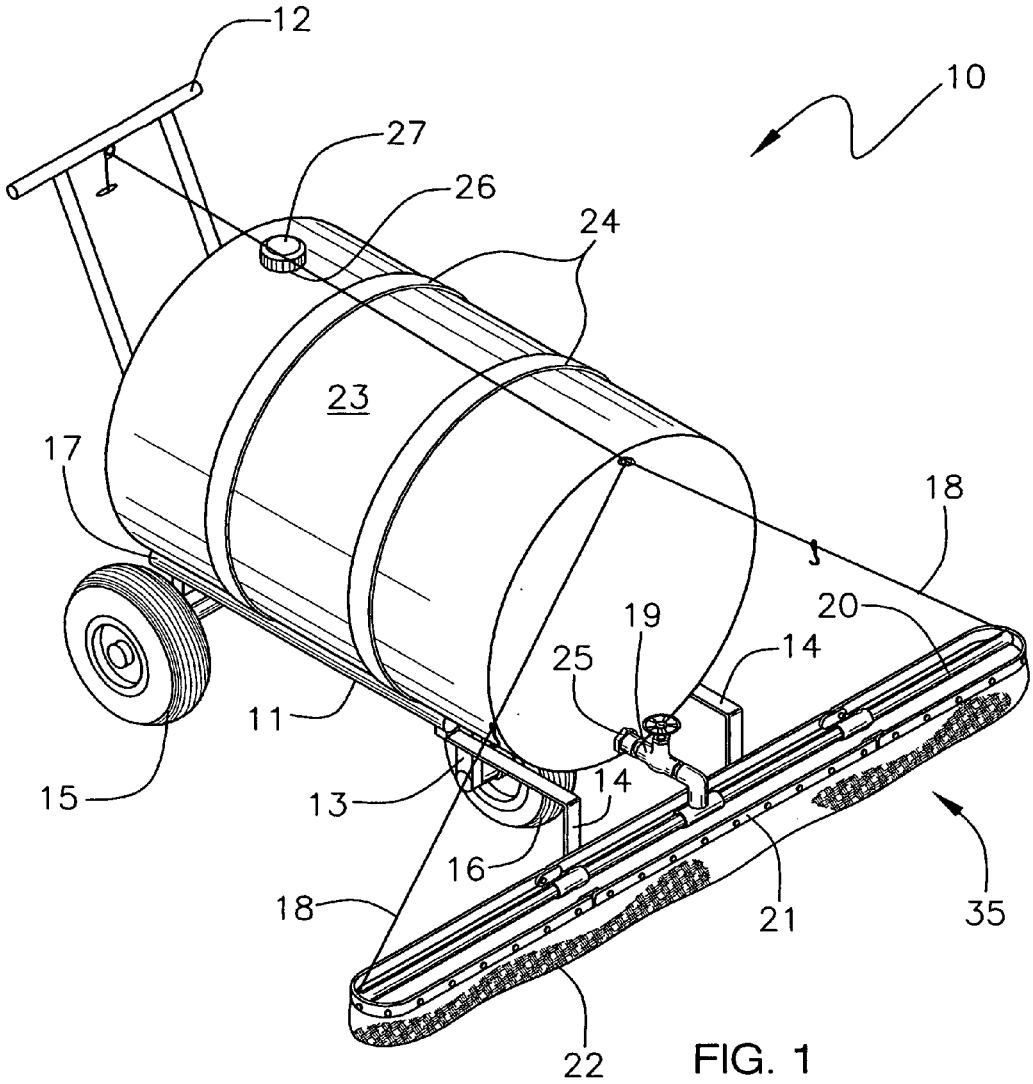
FIG. 1 is a perspective view showing an apparatus for resurfacing an ice rink, in accordance with the present invention.

The apparatus of this invention is referred to generally in FIG. 1 by the reference numeral 10 and is intended to effectively resurface an ice surface. It should be understood that the apparatus 10 may be used to resurface many different types of ice surfaces such as public and private ice rinks, for example. The apparatus 10 includes a dolly 11 including a body defined by a plurality of longitudinally extending support members 17 and a plurality of support members 13, 14 for defining the general shape of the dolly 11. Each longitudinal support member 17 is connected to respective support members 13 at opposite end portions of dolly 11. A handle 12 is connected to a front-end portion of the dolly 11 to therefore allow an operator to either push or pull the apparatus 10 as needed.

The dolly 11 supports a reservoir 23 thereon, which extends along the longitudinal members 17. The reservoir 23 is preferably cylindrically shaped and includes a plurality of apertures 25, 26 formed at opposite end portions thereof. In particular, aperture 26 is formed at the front-end portion thereof and generally on top of the reservoir 23 while aperture 25 this formed at the rear end portion thereof and below aperture 26. A conventional cap 27 can close off aperture 26 so that unwanted debris does not enter the reservoir 23. Of course, reservoir 23 houses fluid therein such as water, for example, for resurfacing an ice rink.

A plurality of straps 24 have opposed end portions connected to the dolly 11 and wrap around the outer surface of the reservoir 23 for assisting to maintain same on the dolly 11 during operating conditions. The dolly 11 further includes a plurality of wheels 15, 16 connected thereto and for allowing same to be easily rolled on an ice surface. A device 35 includes a plurality of components which cooperate with each other for allowing water to be selectively discharged and substantially evenly applied to an ice surface.

In particular, the device 35 includes a conventional spigot or water valve 19 connected to aperture 25 for selectively allowing fluid to discharge from the reservoir 23. Of course, other similar devices may be employed to selectively discharge water from the reservoir 23, as readily known to a person of ordinary skill in the art. The spigot 19 is connected to an elongate pipe 20 including a plurality of connectable sections. A plurality of apertures 38 are formed therein for allowing fluid to discharge therefrom. The elongate pipe 20 is preferably a conventional plastic pipe that will not rust over extended use. In particular, the pipe preferably extends beyond the width of apparatus 10 so that a wide surface area may be treated during each pass.

An elongate support member 21 is formed around pipe 20 and includes a plurality of connectable and pivotable sections. Such a support member 21 is secured to the opposed end portions of pipe 20 for assisting same to be moved between up and down positions during operating conditions. Furthermore, support member 21 helps maintain pipe 20 at a stable position when the dolly 11 is being transported across an ice surface.

A plurality of elongate ropes 18 are connected to the opposed end portions of support member 21 and to the rear end portion of reservoir 23 for helping stabilize the pipe 20 at a substantially horizontal position, as clearly shown. The apparatus 10 further includes an applicator 22, which is connected to support member 21 and extends downwardly therefrom. Such an applicator 22 is provided with a flexible, closed lower end portion for receiving water from pipe 20 and for applying water substantially evenly onto an ice surface as the apparatus 10 is in motion. The applicator 22 is preferably made from cloth material to form a conventional towel, for example. Of course, other well-known materials may be employed, which are suitable for the intended application.

Figure 2:
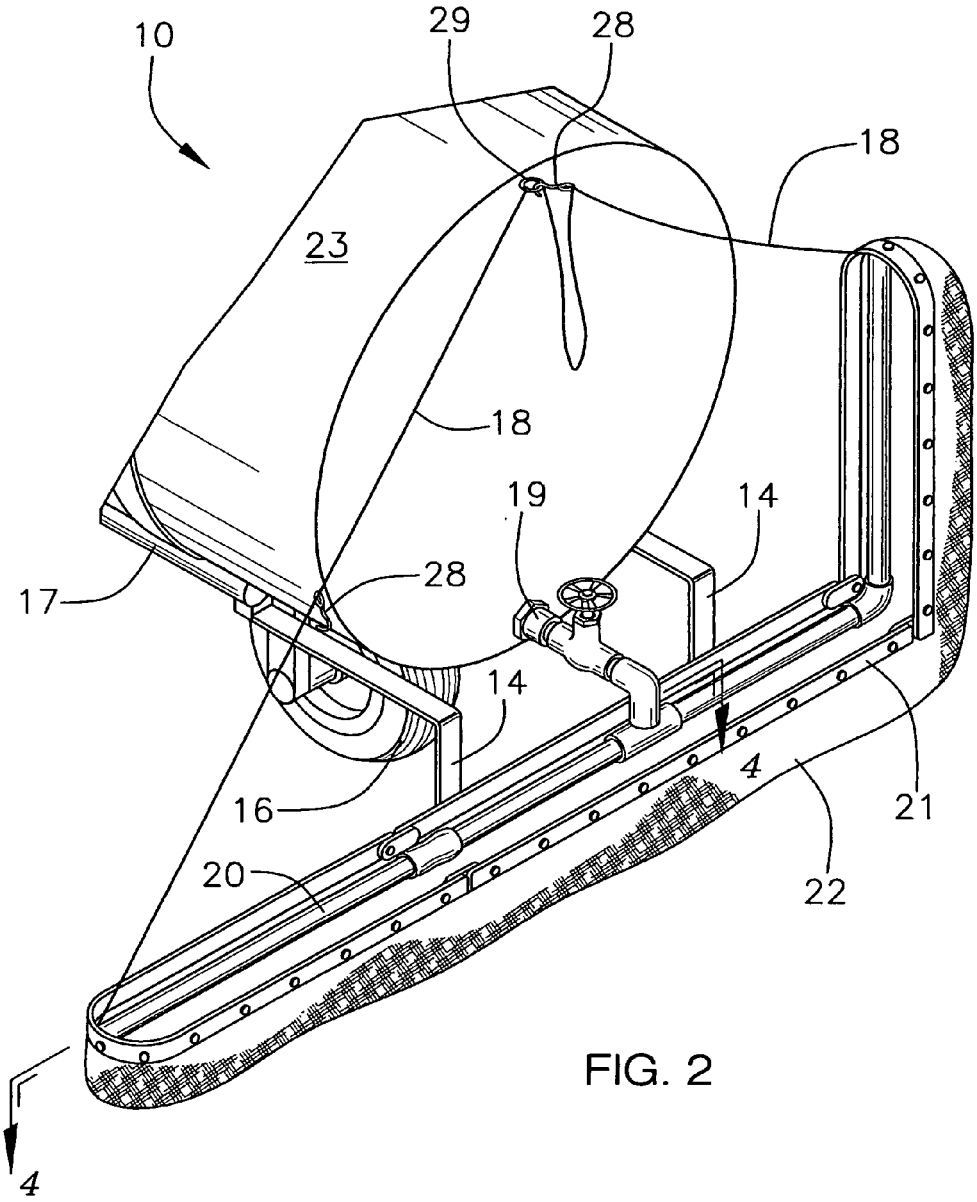
FIG. 2 is a partial enlarged view thereof showing the water-dispersing pipe at a bent position.

Now referring to FIG. 2, it can be seen that pipe 20, support member 21 and applicator 22 may be moved between up and down positions by bending their opposed end portions, respectively. When such opposed end portions are moved to an up position, a plurality of hooks 28, attached to the plurality of ropes 18, may be operably connected to a ring 29 fastened to the rear end portion of the reservoir 23. Accordingly, device 35 may be effectively maintained at such an up position during operating conditions, as desired by a user. Notably, support members 14 extend rearwardly and substantially downwardly, at substantially a perpendicular angle, from support members 13 for connecting to a mid-portion support member 21 and for supporting same adjacent to an ice surface.

Figure 3:
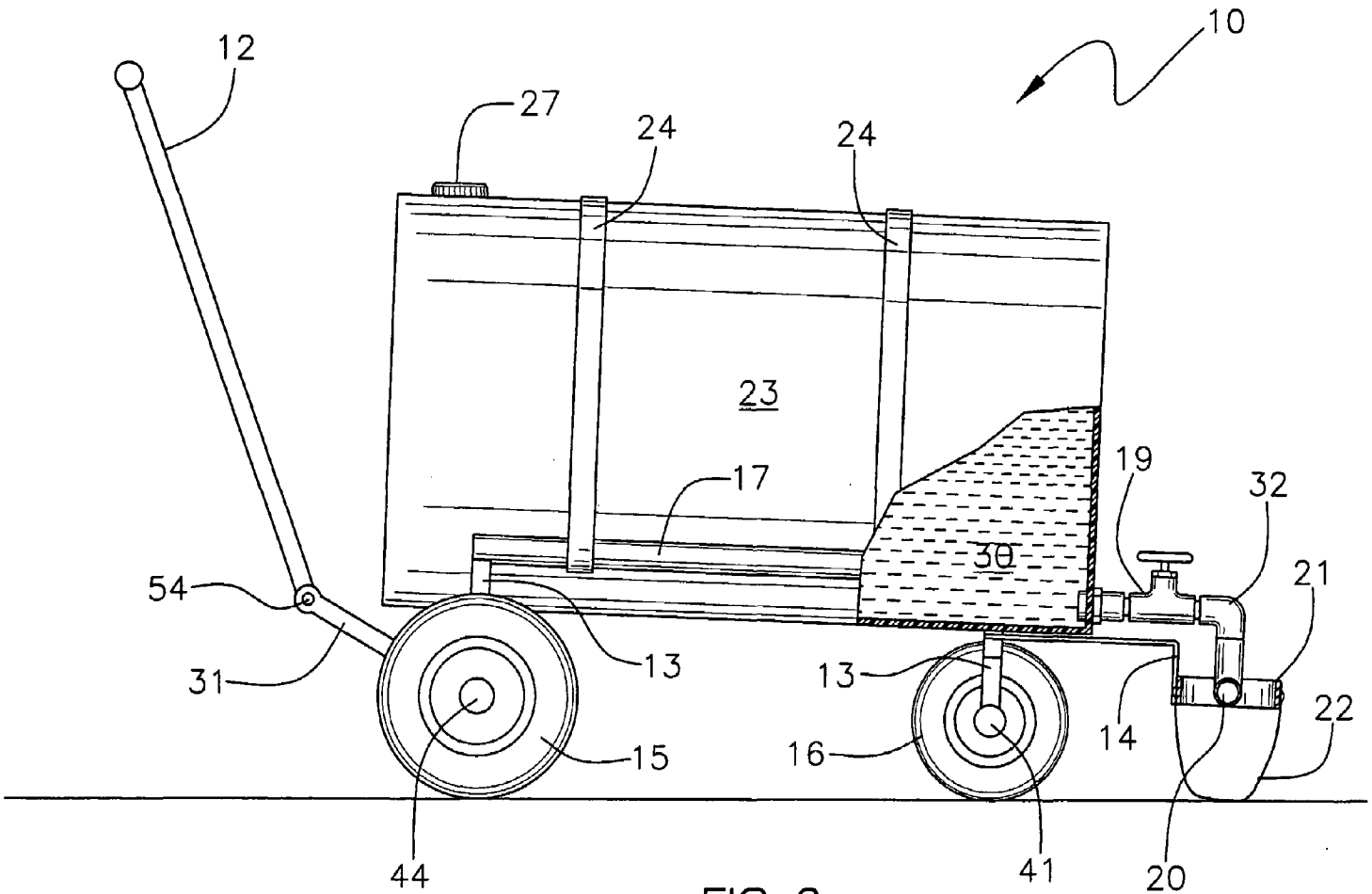
FIG. 3 is a side elevational view thereof showing the reservoir at a slightly tilted position.

Now referring to FIG. 3, handle 12 includes an upper portion pivotally connected, via a conventional locking pin 54, to a lower elongate portion 31 that is securely fastened to a front axle 44 of dolly 11, which passes through wheel 16. Such a lower portion 31 is also connected to support member 13 of dolly 11. Thus, handle 12 may be pivoted about pin 54 for assisting an operator to adjust the height of the handle 12, as needed.

Notably, the front-end portion of reservoir 23 is disposed at a higher elevation and the rear end portion thereof for assisting water 30 to flow rearwardly and out of aperture 25 so that water may be disbursed via pipe 20. A rear axle 41 passes through the plurality of wheels 15 for assisting such wheels to operate in a conventional manner. A flexible coupling or T-member 32 has opposed end portions for connecting spigot 19 to the central portion of pipe 20. Such a coupling member 32 fluidly connects pipe 20 to spigot 19 so that water can be laterally disbursed therefrom.

Figure 4:
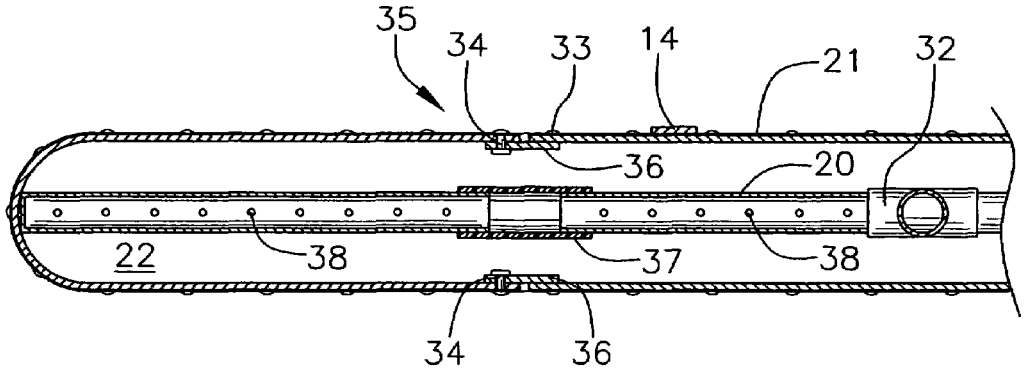
FIG. 4 is an enlarged cross-sectional view taken along line 4—4 in FIG. 2.

Now referring to FIG. 4, it can be seen that device 35 includes a plurality of hinges 36 for operably connecting the mid and opposed end portions of support member 21 via a plurality of corresponding fasteners 34 such as bolts or other conventional fasteners, for example. Thus, the plurality of hinged portions of support member 21 may be pivoted between up and down positions about such hinges 36. Similarly, pipe 20 may be moved between up and down positions about a plurality of flexible couplings 37, which are substantially aligned with hinges 36. Such flexible couplings 37 are preferably formed from conventional bending material, as known in the industry, and for operably connecting the mid and opposed end portions of pipe 20.

Thus, as the opposed end portions of device 35 are moved between up and down positions, the support member 21 and pipe 20 may be moved in unison. Furthermore, because applicator 22 is preferably formed from flexible cloth material, it can also cooperate with the pipe 20 and support member 21 when moved between up and down positions. In particular, applicator 22 is connected to a perimeter of support member 21 via a plurality of fasting members 33 and will conform to the shape its respective end portions. As noted above, pipe 20 is provided with a plurality of apertures 38 substantially equally spaced apart between opposed end portions thereof. Such apertures 38 are formed at a lower portion of pipe 20 so that gravity and water pressure can cause the fluid to exit therethrough and onto an ice surface in a substantially even pattern.

Figure 5:
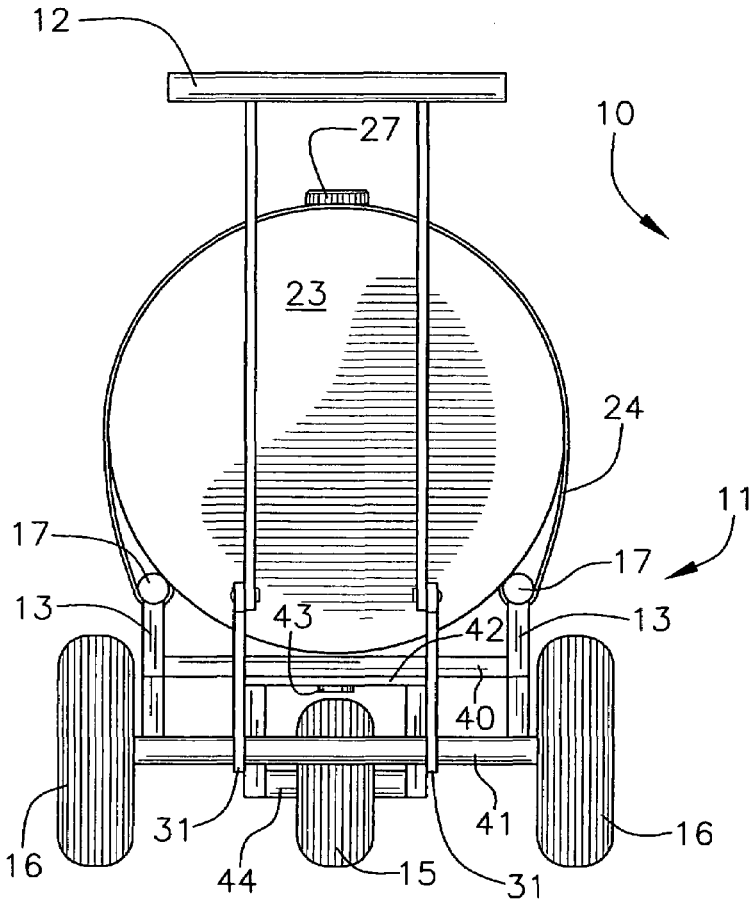
FIG. 5 is a front-end view of the apparatus shown in FIG. 1.

Now referring to FIG. 5, it can be seen that dolly 11 includes at least one horizontal member 40 connected to and disposed between support members 13 adjacent to opposite end portions of dolly 11. To assist an operator to maneuver apparatus 10, front wheel 16 is pivotally connected to dolly 11 via a pivotable bracket 42. Such a bracket 42 is connected to support member 13, which controls wheel 16. The lower portions 31 of handle 12 are also secured to support member 13. Thus, an operator moves handle 12 in a non-orthogonal direction or radial direction, bracket 42 is caused to pivot about pin 43 in a corresponding direction and thereby allow better maneuverability of the apparatus 10. Advantageously, pin 43 pivotally connects bracket 42 to dolly 11 to thereby allow front wheels 16 to be turned in non-orthogonal directions.

In operation, an operator would simply fill the reservoir 23 with water, place the apparatus 10 on an ice surface, such as an ice rink, and open the water spigot 19 connected to the pipe 20. This will release water into the pipe 20 and onto applicator 22 at the lower rear end portion of the apparatus 10. An operator would then pull the apparatus 10 across the frozen ice surface and distribute water thereacross. As the water freezes, it will create a smooth surface on the ice for skaters to enjoy. Advantageously, this helps reduce imperfections on the ice, such as gouges and small holes, which can cause skates to lose their balance and stumble or fall. In this regard, the apparatus 20 can help produce ice that is substantially smooth, thereby making it more enjoyable for skaters to use.

While the invention has been described with respect to certain specific embodiments, it will be appreciated that many modifications and changes may be made by those skilled in the art without departing from the spirit of the invention. It is intended, therefore, by the appended claims to cover all such modifications and changes as fall within the true spirit and scope of the invention.

What is claimed is:

1. An apparatus for resurfacing an ice surface and comprising:

a dolly including a body and a handle attached thereto, a plurality of wheels connected to said body and for supporting same thereon so that said dolly can be rolled on an ice surface;

a reservoir removably fastenable onto said body and for housing fluid therein, said reservoir having a front end portion provided with a first aperture for receiving fluid therethrough and further having a rear end portion provided with a second aperture for dispensing fluid therefrom; and means for operably receiving fluid from the second aperture and distributing fluid substantially evenly onto an ice surface adjacent to the rear end portion of said reservoir;

wherein said fluid receiving and distributing means comprises;

a valve connected to the second aperture and for selectively allowing fluid to flow therefrom;

an elongate pipe connected to said valve and having a plurality of substantially evenly spaced perforations for allowing fluid to pass therethrough;

an elongate support member extending along the length of said pipe and secured thereto at opposed end portions of said pipe and for assisting to maintain same at a substantially stable position during operating conditions;

a plurality of elongate ropes having one end portion attached to the rear end portion of said reservoir respectively and further having an opposed end portion attached to a corresponding end portion of said support member so that same can be maintained at a substantially stable position during operating conditions; and an applicator connected to said support member and for receiving fluid and for assisting to evenly apply fluid onto an ice surface;

wherein said pipe comprises a plurality of flexible couplings spaced apart along a length thereof;

said support member comprises a plurality of hinges spaced apart along a length thereof and substantially aligned with said plurality of flexible couplings;

said plurality of ropes each comprising a fastener attached along a length thereof respectively and removably fastenable to the rear end portion of said reservoir;

the respective opposed end portions of said pipe and said support member being movable between down and up positions about said plurality of flexible couplings and said plurality of hinges so that the amount of fluid dispensed from said pipe can be adjusted as needed, said pipe and said support member being maintainable at up positions when each said fastener is connected to the rear end portion of said reservoir respectively.

2. The apparatus of claim 1, wherein the front end portion of said reservoir is positioned above the rear end portion thereof and for assisting to drain fluid from the reservoir.

3. The apparatus of claim 1, further comprising a plate secured to said dolly, said plate including a pin for pivotally connecting same to said handle so that said dolly can be pulled in different directions during operating conditions.

4. The apparatus of claim 1, further comprising a cap removably attachable to the first aperture of said reservoir and for preventing undesirable elements from entering into said reservoir.

5. The apparatus of claim 1, wherein least one of said plurality of wheels is operably connected to said handle so that said one wheel is caused to move in a direction corresponding to the movement of said handle.

6. The apparatus of claim 1, wherein said applicator is formed from cloth material.

7. An apparatus for resurfacing an ice surface and comprising:

a dolly including a body and a handle attached thereto, a plurality of wheels connected to said body and for supporting same thereon so that said dolly can be rolled on an ice surface;

a reservoir removably fastened onto said body and for housing fluid therein, said reservoir having a front end portion provided with a first aperture for receiving fluid therethrough and further having a rear end portion provided with a second aperture for dispensing fluid therefrom; and means for operably receiving fluid from the second aperture and distributing fluid substantially evenly onto an ice surface adjacent to the rear end portion of said reservoir, said fluid receiving and distributing means comprising a valve connected to the second aperture and for selectively allowing fluid to flow therefrom, an elongate pipe connected to said valve and having a plurality of substantially evenly spaced perforations for allowing fluid to pass therethrough, an elongate support member extending along the length of said pipe and secured thereto at opposed end portions of said pipe and for assisting to maintain same at a substantially stable position during operating conditions, a plurality of elongate ropes having one end portion attached to the rear end portion of said reservoir respectively and further having an opposed end portion attached to a corresponding end portion of said support member so that same can be maintained at a substantially stable position during operating conditions, and an applicator connected to said support member and for receiving fluid and for assisting to evenly apply fluid onto an ice surface;

wherein said pipe comprises a plurality of flexible couplings spaced apart along a length thereof said support member comprises a plurality of hinges spaced apart along a length thereof and substantially aligned with said plurality of flexible couplings;

said plurality of ropes each comprising a fastener attached along a length thereof respectively and removably fastenable to the rear end portion of said reservoir;

the respective opposed end portions of said pipe and said support member being movable between down and up positions about said plurality of flexible couplings and said plurality of hinges so that the amount of fluid dispensed from said pipe can be adjusted as needed, said pipe and said support member being maintainable at up positions when each said fastener is connected to the rear end portion of said reservoir respectively.

8. The apparatus of claim 7, wherein the front end portion of said reservoir is positioned above the rear end portion thereof and for assisting to drain fluid from the reservoir.

9. The apparatus of claim 7, further comprising a plate secured to said dolly, said plate including a pin for pivotally connecting same to said handle so that said dolly can be pulled in different directions during operating conditions.

10. The apparatus of claim 7, further comprising a cap removably attachable to the first aperture of said reservoir and for preventing undesirable elements from entering into said reservoir.

11. The apparatus of claim 7, wherein at least one of said plurality of wheels is operably connected to said handle so that said one wheel is caused to move in a direction corresponding to the movement of said handle.

12. The apparatus of claim 7, wherein said applicator is formed from cloth material.

13. An apparatus for resurfacing an ice rink and comprising:

a dolly including a body and a handle attached thereto, a plurality of wheels connected to said body and for supporting same thereon so that said dolly can be rolled on an ice surface;

a reservoir removably fastened onto said body and for housing fluid therein, said reservoir having a front end portion provided with a first aperture for receiving fluid therethrough and further having a rear end portion provided with a second aperture for dispensing fluid therefrom, said reservoir including a cap removably attachable to the first aperture and for preventing undesirable elements from entering into said reservoir; and means for operably receiving fluid from the second aperture and distributing fluid substantially evenly onto an ice surface adjacent to the rear end portion of said reservoir, said fluid receiving and distributing means comprising a valve connected to the second aperture and for selectively allowing fluid to flow therefrom, an elongate pipe connected to said valve and having a plurality of substantially evenly spaced perforations for allowing fluid to pass therethrough, an elongate support member extending along the length of said pipe and secured thereto at opposed end portions of said pipe and for assisting to maintain same at a substantially stable position during operating conditions, a plurality of elongate ropes having one end portion attached to the rear end portion of said reservoir respectively and further having an opposed end portion attached to a corresponding end portion of said support member so that same can be maintained at a substantially stable position during operating conditions, and an applicator connected to said support member and for receiving fluid and for assisting to evenly apply fluid onto an ice surface;

wherein said pipe comprises a plurality of flexible couplings spaced apart alone a length thereof;

said support member comprises a plurality of hinges spaced apart along a length thereof and substantially aligned with said plurality of flexible couplings;

said plurality of ropes each comprising a fastener attached along a length thereof respectively and removably fastenable to the rear end portion of said reservoir;

the respective opposed end portions of said pipe and said support member being movable between down and up positions about said plurality of flexible couplings and said plurality of hinges so that the amount of fluid dispensed from said pipe can be adjusted as needed, said pipe and said support member being maintainable at up positions when each said fastener is connected to the rear end portion of said reservoir respectively.

14. The apparatus of claim 13, wherein the front end portion of said reservoir is positioned above the rear end portion thereof and for assisting to drain fluid from the reservoir.

15. The apparatus of claim 13, further comprising a plate secured to said dolly, said plate including a pin for pivotally connecting same to said handle so that said dolly can be pulled in different directions during operating conditions.

16. The apparatus of claim 13, wherein at least one of said plurality of wheels is operably connected to said handle so that said one wheel is caused to move in a direction corresponding to the movement of said handle.

* * * * *